US011324316B2

(12) United States Patent
Janser

(10) Patent No.: US 11,324,316 B2
(45) Date of Patent: May 10, 2022

(54) ARRANGEMENT CONSISTING OF A PULL-OUT GUIDE AND A DRIVER

(71) Applicant: Julius Blum GmbH, Hoechst (AT)

(72) Inventor: Pascal Janser, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 16/925,935

(22) Filed: Jul. 10, 2020

(65) Prior Publication Data

US 2020/0367649 A1 Nov. 26, 2020

Related U.S. Application Data

(63) Continuation of application No. PCT/AT2018/060306, filed on Dec. 18, 2018.

(30) Foreign Application Priority Data

Jan. 12, 2018 (AT) ..... A 50018/2018

(51) Int. Cl.
*A47B 88/497* (2017.01)

(52) U.S. Cl.
CPC .... *A47B 88/497* (2017.01); *A47B 2210/0056* (2013.01)

(58) Field of Classification Search
CPC ..... A47B 88/40; A47B 88/423; A47B 88/497
USPC ..... 312/330.1, 319.1, 334.1, 334.8
See application file for complete search history.

(56) References Cited

U.S. PATENT DOCUMENTS 7,748,799 B2 * 7/2010 Kleinsasser ..... A47B 88/463 312/319.1
8,109,582 B2 * 2/2012 Dubach ..... A47B 88/463 312/319.1
8,678,528 B2 3/2014 Domenig et al.
9,125,490 B2 9/2015 Haemmerle et al.
9,681,748 B2 6/2017 Chen et al.
10,085,558 B2 10/2018 Klaus
(Continued)

FOREIGN PATENT DOCUMENTS

CN 201806252 4/2011
CN 103142043 6/2013
(Continued)

OTHER PUBLICATIONS

International Search Report issued Jan. 31, 2019 in International (PCT) Application No. PCT/AT2018/060306.

*Primary Examiner* — James O Hansen
(74) *Attorney, Agent, or Firm* — Wenderoth, Lind & Ponack, L.L.P.

(57) ABSTRACT

An arrangement includes a first pull-out guide and a driver for a drive device for moving a movable furniture part in relation to a furniture body. The driver includes a driver projection to be actively connected to the drive device, a first fastening device with a part arranged on the driver, and a part arranged on the first pull-out guide. One part of the first fastening device is a pin, and one part is a pin-receiving element corresponding to the pin. The pin is positioned obliquely to the longitudinal axis of the first pull-out guide. The driver includes a part of a second fastening device for optional fastening of the driver to a second pull-out guide substantially laterally reversed in relation to the first pull-out guide. The part of the first fastening device is laterally reversed in relation to the part of the second fastening device.

37 Claims, 16 Drawing Sheets

(56) References Cited

U.S. PATENT DOCUMENTS

| | | | |
|---|---|---|---|
| 10,143,303 | B2 | 12/2018 | Koenig et al. |
| 10,172,461 | B2 | 1/2019 | Fischer et al. |
| 10,285,500 | B2 | 5/2019 | Stuffel et al. |
| 10,485,342 | B2 | 11/2019 | Fischer et al. |
| 10,743,659 | B2 | 8/2020 | Fischer et al. |
| 2007/0222346 | A1 | 9/2007 | Kleinsasser |
| 2011/0115353 | A1 | 5/2011 | Domenig et al. |
| 2013/0293078 | A1 | 11/2013 | Haemmerle et al. |
| 2013/0328468 | A1 | 12/2013 | Schneider et al. |
| 2017/0020285 | A1 | 1/2017 | Schallert et al. |
| 2017/0056854 | A1 | 3/2017 | Gu |
| 2017/0095084 | A1 | 4/2017 | Koenig et al. |
| 2017/0105525 | A1 | 4/2017 | Klaus |
| 2017/0112280 | A1 | 4/2017 | Fischer et al. |
| 2017/0135479 | A1 | 5/2017 | Chen et al. |
| 2017/0265644 | A1 | 9/2017 | Fischer et al. |
| 2018/0146783 | A1 | 5/2018 | Stuffel et al. |
| 2020/0046118 | A1 | 2/2020 | Fischer et al. |

FOREIGN PATENT DOCUMENTS

| | | |
|---|---|---|
| CN | 103298372 | 9/2013 |
| CN | 203354019 | 12/2013 |
| CN | 106102518 | 11/2016 |
| CN | 106455812 | 2/2017 |
| CN | 107105896 | 8/2017 |
| CN | 107567292 | 1/2018 |
| DE | 20 2012 003 004 | 8/2013 |
| EP | 3 167 753 | 5/2017 |
| JP | 2017-511189 | 4/2017 |
| JP | 2017-515129 | 6/2017 |
| JP | 2017-523824 | 8/2017 |
| TW | 201605383 | 2/2016 |
| WO | 2006/058351 | 6/2006 |
| WO | 2012/156229 | 11/2012 |
| WO | 2016/000003 | 1/2016 |

* cited by examiner

ZW

B1

VB

VB

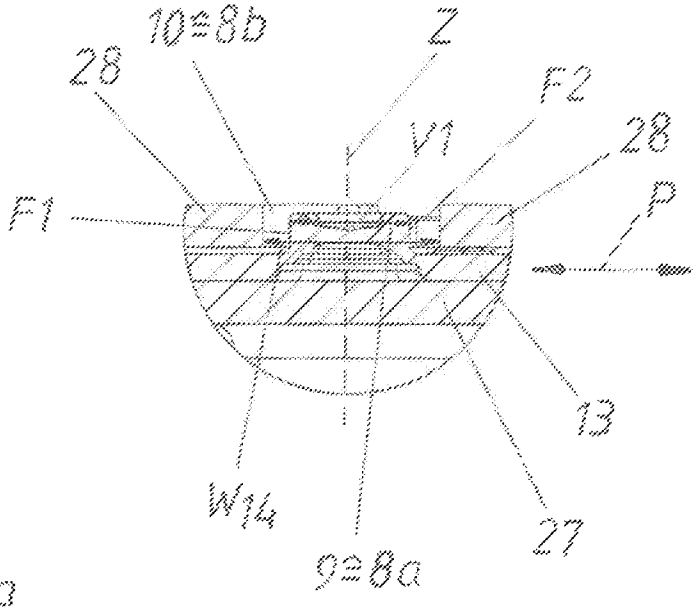
Fig. 15
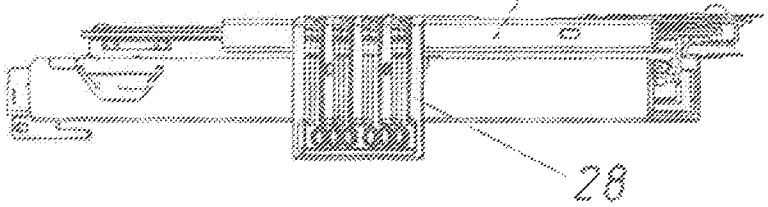
Fig. 14
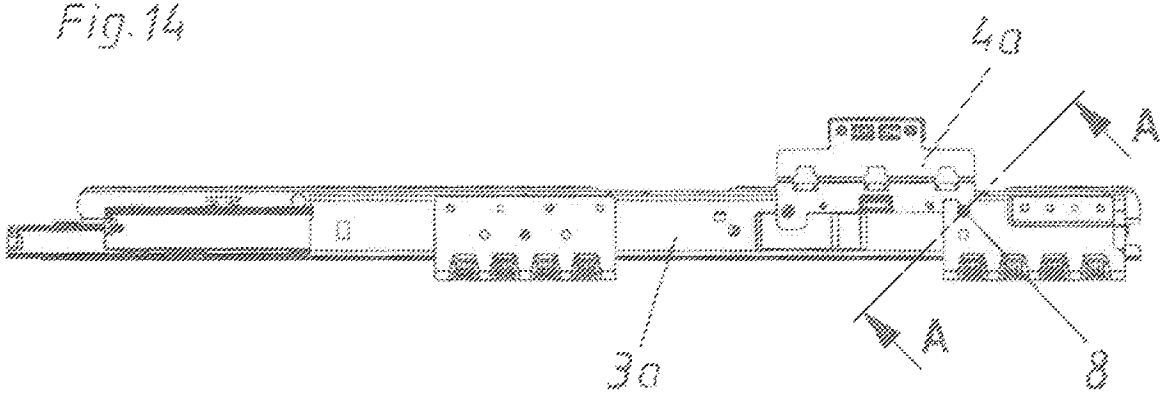

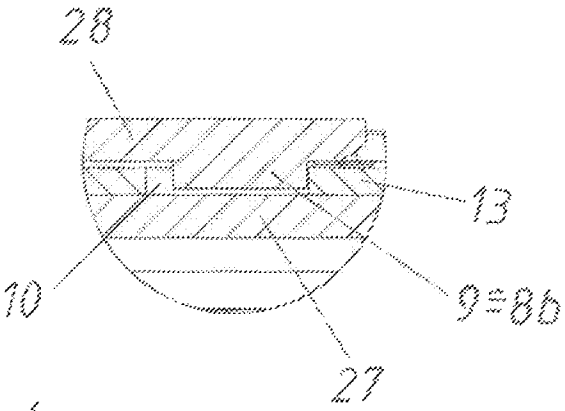
Fig. 21
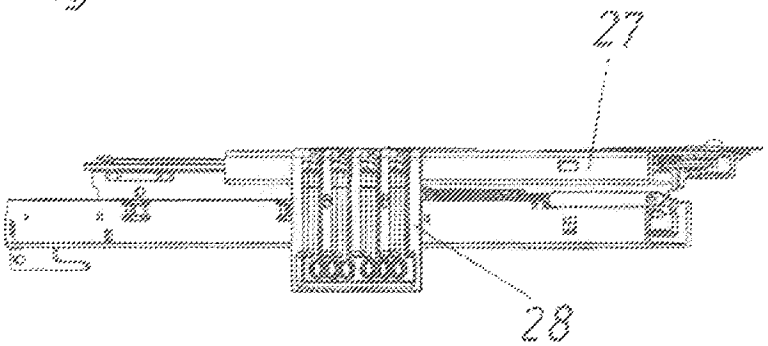
Fig. 20
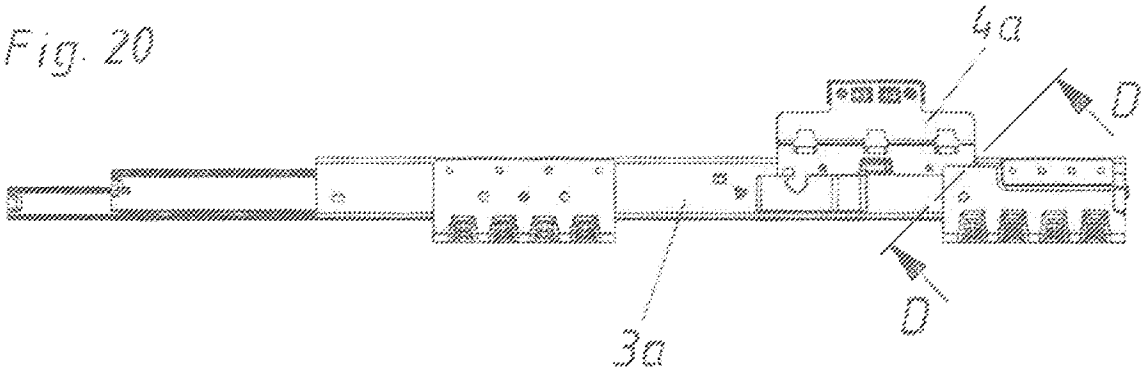

ARRANGEMENT CONSISTING OF A PULL-OUT GUIDE AND A DRIVER

BACKGROUND OF THE INVENTION

The invention concerns an arrangement comprising a first extension guide for a movable furniture part and an entrainment member for a drive device for moving the movable furniture part in relation to a furniture carcass. The entrainment member comprises an entrainment projection that can be actively connected to the drive device, and a first fastening device is provided with a part which is arranged on the entrainment member and a part which is arranged on the first extension guide, by means of which the entrainment member can be fastened to the first extension guide. One part of the first fastening device is embodied as a pin, and one part is embodied as a pin-receiving element corresponding to the pin. The pin is positioned obliquely to the longitudinal axis of the first extension guide and the pin receiving element comprises an insertion channel for the pin, which insertion channel comprises a bottleneck. In addition, the invention concerns an item of furniture with such an arrangement and a method for fastening an entrainment member of such an arrangement on an extension guide of such an arrangement.

For many years, drive devices have been known in the industry of furniture fittings by way of which a movement of a movable furniture part is supported mechanically. For this purpose, ejection devices in the form of so-called touch latch mechanisms or also retraction devices are known. Mostly, these drive devices are arranged on the furniture carcass or on the movable furniture part. Such drive devices are actively connected with an entrainment member which e. g. in the case of a drive device arranged on the movable furniture part is associated to the furniture carcass or to a carcass rail of an extension guide.

A generic arrangement is disclosed in the FIGS. 1 to 10 of WO 2016/000003 A1. This document shows an entrainment member which can be brought from a release position into a fixed position with the rail by a fastening movement, wherein the fastening movement is carried out in a horizontal plane. This means, in this case the drive device is arranged on the bottom side of a drawer base or is connected to the drawer rail and can be actively connected to the entrainment member attached to the carcass rail. The entrainment member comprises an entrainment pin. A first connecting piece is provided for the fastening of the entrainment member to the rail, which first connecting piece is protruding vertically from a plate-shaped base region of the entrainment member. This first connecting piece comprises a neck area in the form of a cylinder with a substantially square-shaped base area. A second and a third connecting piece are bent out from or punched out from the holding plate of the entrainment member. During a fastening movement along a straight line when inserting the entrainment member into the rail, the neck area of the entrainment member exactly fits through a bottleneck which the connecting counter piece is forming on the rail. As soon as the pre-mounting state is reached after this insertion, the second part of the fastening movement is carried out in the horizontal plane by a swivelling movement around the vertical axis formed by the first connecting piece. At the end of this swivelling movement the second connecting piece reaches a friction-type connection with the second connecting counter piece and also the third connecting piece reaches a friction-type connection with the third connecting counter piece, whereby the fixed position is reached. Per se, this swivelling fastening movement is advantageous as this movement can also be carried out in a quite simple and uncomplicated manner in the case of an already integrated extension guide. In addition, a safe connection is given by the neck area fitting through the bottleneck and the subsequent swivelling movement.

However, it is disadvantageous in this embodiment that for one side of an extension guide an entrainment member has to be used which is mirror-inverted to the other side of the extension guide. This means, two different types of entrainment member must be provided for each drawer. Therefore, the production effort is higher. Also, the warehousing is virtually doubled.

In contrast, the FIGS. 11 to 13 of the WO 2016/000003 A1 show an entrainment member according to which a purely linear fastening movement is given. In this design example connecting counter pieces in the form of U-shaped lugs are formed on the bottom of the rail. These connecting counter pieces form the guiding elements for the entrainment member. Slightly bent connecting pieces are formed on the holding plate of the entrainment member. By inserting the entrainment member during the fastening movement the slightly bent connecting pieces reach a position between the connecting counter pieces and the bottom of the rail. As a consequence, the fixed position is reached without swivelling. A ribbed surface is formed each on the bottom of the connecting counter piece and on the upper side of the connecting piece. These ribbed surfaces are meshing or locking with each other so that a positive-locking holding between the entrainment member and the rail is guaranteed. On the one hand, it is disadvantageous in this design example that during fastening both connecting pieces have to be threaded at the same time which can lead to quite some problems due to the limited space and due to the unclear visibility in this region of the drawer. On the other hand, it is disadvantageous that by the locking via the ribbed surfaces a later loosening is virtually not possible without damage. For such a loosening the lug must be forced apart or the slightly bent connecting piece must be somehow pressed downwardly with an external force so that the single teeth of the ribbed surface can be released from each other. Thus, the FIGS. 11 to 13 of this document only show a variant for a one-time fastening of the entrainment member.

SUMMARY OF THE INVENTION

The object of the present invention is to provide an improved arrangement compared to the prior art. In particular, the fastening shall be carried out as simple as possible, uncomplicated and in a safe manner. In addition, a double warehousing shall be prevented. Moreover, the fastening of the entrainment member shall be as simple as possible and the entrainment member shall be detachable.

According to the invention it is provided that the entrainment member comprises a part of a second fastening device, which is embodied as a pin or as a pin-receiving element, for optional fastening of the entrainment member to a second extension guide which is substantially laterally reversed in relation to the first extension guide. The part of the first fastening device, which is arranged on the entrainment member, is arranged on the entrainment member such that it is laterally reversed in relation to the part of the second fastening device, arranged on the entrainment member.

By way of this second fastening device which is formed mirror-symmetrically to the first fastening device on the entrainment member, the same entrainment member can be fastened via this second fastening device to a second extension guide on the opposite side correspondingly. Thus, two substantially identical entrainment members can be used, wherein one entrainment member is fastened to the first extension guide via a first fastening piece and the other entrainment member can be fastened to the second extension guide via the part of the second fastening device. Therefore, no double warehousing is necessary. In addition, a simple detachable fastening is reached by means of the pin and the pin-receiving element. Moreover, the possible swivelling movement simplifies the fastening process.

The arrangement is not obvious from a combination of the two design examples of the WO 2016/000003 A1. In theory, a person skilled in the art could indeed replace the two bent connecting pieces of the FIGS. 11 to 13 each by a first connecting piece of the design example according to the FIGS. 1 to 10. As a consequence, however, there would not be a safe connection as for the first connecting pieces with the neck regions and the corresponding bottlenecks a swivelling movement is indeed mandatory for a positive-locking holding. If, thus, —as in the FIGS. 11 to 13—the linear fastening movement is carried out, theoretically arranged first connecting pieces could not be fastened in a positive-locking manner with the neck region.

Basically, there are two design possibilities—which are alternative to each other—concerning the pin and the pin-receiving element. According to a first variant, the parts of the first fastening device and of the second fastening device formed on the entrainment member are embodied as pins, and the pin-receiving element is arranged on the extension guide. According to a second variant, the parts of the first fastening device and of the second fastening device formed on the entrainment member are embodied as pin-receiving elements and that the pin is arranged on the extension guide All of the examples mentioned in this application and all detailed definitions of the pin and the pin-receiving element apply for each of these parts, independent from the position where the pin and where the pin-receiving element is arranged. This means, if the pin is described with reference to an arrangement on the entrainment member, this applies—as long as it makes logical sense—also the other way round when arranging the pin on the extension guide. Also, the described fastening movement applies analogously for both exemplary embodiments.

Preferably, parts of exactly two fastening devices (namely of the first fastening device and of the second fastening device) are embodied on the entrainment member.

Preferably, only one pin or one pin-receiving element is arranged on the first extension guide. This means, a part of exactly one fastening device is embodied on the extension guide.

As in the assembly condition only one part of both fastening devices arranged on the entrainment member fulfils a function, it is preferably provided that in the assembly condition of the arrangement the part of the second fastening device arranged on the entrainment member is distanced from the part of the first fastening device arranged on the extension guide. This means that the pin or the pin-receiving element of the second fastening device is functionless or connectionless to the respective extension guide.

The entrainment member per se can be formed arbitrarily, as long as the entrainment member comprises the entrainment projection and both parts of the first fastening device and of the second fastening device.

According to a preferred exemplary embodiment, the entrainment member comprises a base plate. This base plate preferably can be embodied as sheet metal. Preferably, this sheet metal has a substantially constant sheet thickness. This sheet thickness is between 0.5 mm and 1.5 mm and is preferably between 0.7 mm and 1.0 mm. Concretely, a sheet thickness of 0.8 mm is provided.

In a similar manner also the extension guide comprises rails in the form of a sheet metal. Also, here the sheet thickness, e. g. of the components of a carcass rail, is between 0.5 mm and 1.5 mm.

The entrainment projection can be formed as an integral part of this base plate. For example, the entrainment projection can also be stamped out and bent open or bent from the base plate. Preferably, however, the entrainment projection is formed as an attachment part which is separate from the base plate. Preferably, this attachment part is made of plastic.

The base plate as a whole is formed substantially flat. Preferably, the base plate is extending along a plate plane. In particular, the main part of the flat surface of the base plate is extending parallel to this plate plane.

Particularly preferred, the plate plane is oriented parallel to the longitudinal extension of the extension guide and horizontally in the assembly condition of the arrangement.

According to a particularly preferred exemplary embodiment of the present invention, the base plate has a height—measured right-angled to the plate plane—of four sheet thicknesses at maximum, preferably of three sheet thicknesses at maximum.

Preferably, the base plate in the region of the first fastening device and of the second fastening device has a height of two sheet thicknesses at maximum. As a consequence, the present arrangement can be used in the item of furniture in a very space-saving manner.

The parts of the first fastening device and of the second fastening device arranged on the entrainment member can be formed separately from the base plate. This means, these parts for example can be connected detachably with the base plate. Preferably, however, the parts of the first fastening device and of the second fastening device arranged on the entrainment member are formed in one piece with the base plate. If these parts are formed as pins, these pins can be embossed into this base plate correspondingly. If these parts are formed as pin-receiving elements, these elements can be stamped out or formed into the base plate correspondingly.

For a simple design, preferably the entrainment member comprises a central plane of symmetry which is right-angled to the plate plane. Particularly preferred, in the fastening state, the plane of symmetry is oriented right-angled to the longitudinal extension of the first extension guide.

The fastening state is a state in which the entrainment member is situated in a connected position with the extension guide. This means the entrainment member is connected in a fixed manner (however detachable) with the extension guide.

In comparison, the assembly condition is a state in which the whole arrangement, thus the extension guide together with the entrainment member, is mounted to the furniture carcass of the item of furniture. This assembly condition can also be referred to as mounting position. This assembly condition is of importance especially for the definition of the terms “horizontal” and “vertical”.

According to a preferred exemplary embodiment, the part of the first fastening device arranged on the entrainment member and the part of the second fastening device arranged on the entrainment member in each case are arranged on a side of the plane of symmetry laterally reversed to each other.

In principle, it is possible that an entrainment member comprises more than one entrainment projection. If two entrainment projections are provided, these two projections should be arranged each on one side of the plane of symmetry laterally reversed to each other. Preferably, however, it is provided that the plane of symmetry leads through the entrainment projection. In this case it is particularly preferred that only one entrainment projection is embodied on the entrainment member.

For a further preferred exemplary embodiment, the plane of symmetry divides the entrainment member into a first symmetry area and a second symmetry area. Thus, not only the two parts of the first fastening device and of the second fastening device are arranged laterally reversed to each other, but the whole entrainment member simply has two symmetry areas.

It is possible in general that the entrainment member itself is not formed completely mirror-symmetrically. Thus, asymmetric components can be arranged on the entrainment member depending on the intended use and depending on the possible applications. Particularly preferred, the two symmetry areas of the entrainment member are embodied mirror-symmetrically to each other.

Particularly preferred, in the fastening state of the arrangement, the pin rests on the pin-receiving element. In this case there can be a friction-type connection per se. Preferably, however, there is a positive-locking connection between the pin and the pin-receiving element at least in a movement direction right-angled to the longitudinal extension of the extension guide.

The pin of the fastening device is positioned obliquely to the longitudinal axis of the first extension guide so that a connection is possible with the corresponding counter piece. Preferably, in the assembly condition of the arrangement, the pin is projecting vertically from the entrainment member or from the first extension guide.

According to a preferred exemplary embodiment, the pin comprises a central pin axis.

The pin axis can be oriented e. g. in a region from 45° to 135° in relation to the plate plane. Preferably, the pin axis is oriented right-angled to the longitudinal axis of the first extension guide. In addition, the pin axis oriented vertically in the assembly condition.

Further, the pin can comprise a lateral surface which is formed around the pin axis and which fully encloses the pin axis in the radial direction. Thus, the pin is at least partially formed as a cylinder in a geometrical sense.

According to a preferred exemplary embodiment, the lateral surface deviates from a circular shape in a cross section which is right-angled to the pin axis. Put in other words, this means that the length of a first straight connection line which is oriented right-angled to the plane of symmetry and parallel to the plate plane and which line is running from a first position of the lateral surface through the pin axis till a position of the lateral surface opposite to the first position is larger than the length of a second straight connection line which is oriented obliquely to the plane of symmetry and parallel to the plate plane and which line is running from a second position of the lateral surface through the pin axis till a position of the lateral surface opposite to the second position.

The lateral surface for example can be formed rectangular or oval in the cross section which is right-angled to the pin axis. Particularly preferred, the lateral surface—in the cross section right-angled to the pin axis—comprises two flattened areas on radially opposing sides and two convex areas on radially opposing sides Further, the shortest straight connection line—which is leading through the pin axis—between the flattened areas is shorter than the shortest straight connection line—which is leading through the pin axis—between the convex areas.

Preferably, the flattened areas are oriented obliquely, preferably in an angle region between 35° and 55°, to the longitudinal axis of the extension guide. This applies when the pin is arranged on the entrainment member. In the case of a pin arranged on the extension guide, the flattened areas are oriented right-angled to the longitudinal axis.

Concerning the pin-receiving element of the fastening device, the pin-receiving element is preferably formed in the entrainment member or in the first extension guide, wherein a recess edge of the pin-receiving element is embodied on the entrainment member or on the first extension guide.

The most important feature of the pin-receiving element is that it comprises an insertion channel for the pin with a bottleneck. In addition, the pin-receiving element comprises a bearing region for the pin, which bearing region is separate from the insertion channel. Particularly preferred, the bearing region is formed by a substantially circle-shaped recess edge of the pin-receiving element. This recess edge describes approximately a ¾ circle in the bearing region.

In order to reach a relative simply detachable and positive-locking fastening of the entrainment member on the extension guide, preferably the minimal clear width in the area of the bottleneck of the insertion channel is smaller than the minimal clear width in the bearing region. Preferably, the relation on the minimal clear width in the area of the bottleneck to the minimal clear width in the bearing region is between 1 to 8 and 7 to 8, preferably between 2 to 5 and 4 to 5.

Preferably, the minimal clear width in the area of the bottleneck is positioned obliquely, preferably in an angle region between 35° and 55°, to the longitudinal axis of the extension guide. This applies when the parts of the fastening devices on the entrainment member are embodied as pin-receiving elements. When the part of the (first) fastening device on the extension guide is embodied as pin-receiving element, preferably the minimal clear width is oriented parallel to the longitudinal axis.

For a fastening movement which is as simple as possible, preferably the insertion channel comprises a broader threading region adjacent to the bottleneck, the threading region preferably being tapered in the direction of the bottleneck. This threading region is preferably arranged on the side of the bottleneck which is remote from the bearing region. Thus, the pin can be correspondingly moved at the beginning of the fastening movement via the threading region in the direction of the bottleneck.

The pin and the pin-receiving element per se can be arranged and oriented arbitrarily as long as a simple fastening movement is guaranteed. Particularly preferred, during a mounting movement, the pin can pass the bottleneck of the pin-receiving element only when the entrainment member is positioned obliquely with respect to the longitudinal axis of the first extension guide. Particularly preferred, during this mounting movement, during which the pin can pass the bottleneck of the pin-receiving element, the plane of symmetry of the entrainment member is oriented at an angle between 30° and 60°, preferably between 40° and 50°, to the longitudinal axis of the first extension guide.

Per se, it is sufficient when the fastening of the entrainment member to the extension guide is carried out only via the first or the second fastening device. Preferably, however, for an even safer hold, the entrainment member comprises a, preferably tongue-shaped, clamping element which is separate from the parts of the fastening devices and which is connected to the extension guide in the assembly condition.

In particular, this clamping element rests on a clamping counter surface or on a clamping element counter piece of the extension guide.

The clamping element can be arranged on an arbitrary position of the entrainment member. Preferably, the plane of symmetry is running centrally through the clamping element.

For the first extension guide, preferably this extension guide comprises a carcass rail and a drawer rail which is movable relative to the carcass rail. A central rail can be provided optionally for a full extension.

If a drive device is associated to the movable furniture part, preferably the part of the first fastening device arranged on the first extension guide is arranged on the carcass rail.

The part of the fastening device arranged on the extension guide (preferably on the carcass rail) can be formed as a separate attachment part for the extension guide.

Preferably, however, the part of the (first) fastening device arranged on the carcass rail is formed integrally with the carcass rail, preferably is formed into the carcass rail.

Up to here, the present invention and the arrangement have been described with exactly one entrainment member and exactly one extension guide. In order to have a fully functioning furniture fitting for a movable furniture part in form of a drawer a second extension guide is provided which is formed laterally reversed to the first extension guide. In addition, preferably a second entrainment member for the second extension guide is provided, wherein the second entrainment member is formed identically to the entrainment member of the first extension guide. As a consequence, a particularly simple warehousing is possible.

Particularly preferred, the part of the first fastening device arranged on the second extension guide simultaneously forms a part of the second fastening device.

According to a preferred exemplary embodiment, at least one drive device, preferably an ejection device, for moving the movable furniture part relative to the furniture carcass is provided, wherein the drive device can be actively connected to the entrainment member.

For a secure and constant movement of the movable furniture part, one drive device is provided for each extension guide. These two drive devices are actively connected to the respective entrainment member.

Protection is also sought for an item of furniture comprising a furniture carcass, a movable furniture part (in particular a drawer) and an arrangement according to the invention.

According to a preferred exemplary embodiment, two drive devices, preferably arranged on the bottom side of the movable furniture part embodied as a drawer, can be provided. A first drive device is associated to the first extension guide and to the entrainment member, and a second drive device is associated to the second extension guide and to the second entrainment member.

Further, at least in a closed position of the movable furniture part, the first drive device rests on the entrainment member and the second drive device rests on the second entrainment member. In particular, the entrainment members and the drive devices are abutting each other during an unlocking movement and a subsequent opening movement. In the case of a further opening and also during a part of the closing movement, there can also be a freewheel during which the drive devices are not in contact with the entrainment members.

When the drive device is embodied as an ejection device, preferably this ejection device comprises an ejection force storage member, a movable ejection element which is force-actuated by the ejection force storage member and a locking device for locking the ejection element in the locking position. Preferably, the ejection element can be unlocked by over-pressing the drawer into an over-pressing position beyond a closed position of the drawer and that—when the ejection element is unlocked—the drawer is movable in opening direction by way of the ejection force storage member and the ejection element.

Moreover, protection is sought for a method for fastening an entrainment member of an arrangement according to the invention to a first extension guide of an arrangement according to the invention. For this method, the entrainment member can be brought from a pre-fastening state, in which the entrainment member is positioned obliquely to the longitudinal axis of the first extension guide, by means of the first fastening device into a fastening state with the first extension guide. This is carried out by moving the pin through the bottleneck of the insertion channel and by a subsequent swivelling around the pin of the first fastening device. Thus, the pin forms a kind of a swivelling axis, wherein by way of this swivelling a positive-locking connection between the pin and the pin-receiving element is established as then the relatively broad regions of the pin rest on the recess edge of the bearing region and a movement of the pin through the bottleneck is prevented.

Preferably, a second entrainment member, which is formed identically to the (first) entrainment member, can be brought from a pre-fastening state, in which the second entrainment member is positioned obliquely to the longitudinal axis of a second extension guide, by means of the part of the second fastening device arranged on the second entrainment member and by means of the part of the first fastening device arranged on the second extension guide into a fastening state with the second extension guide. This is carried out by moving the pin through the bottleneck of the insertion channel and by a subsequent swivelling around the pin of the first fastening device.

BRIEF DESCRIPTION OF THE DRAWINGS

Further details and advantages of the present invention are described more fully hereinafter by means of the specific description with reference to the embodiments by way of example illustrated in the drawings, in which:

FIG. 14 shows the arrangement together with the first fastening device from below, FIG. 15 shows the cross section A-A from FIG. 14 in a detail with the first fastening device, FIG. 20 shows an arrangement together with the first fastening device of the second exemplary embodiment from below and FIG. 21 shows the cross section D-D from FIG. 20 together with a detail of the first fastening device.

DETAILED DESCRIPTION OF THE INVENTION

Figure 1:
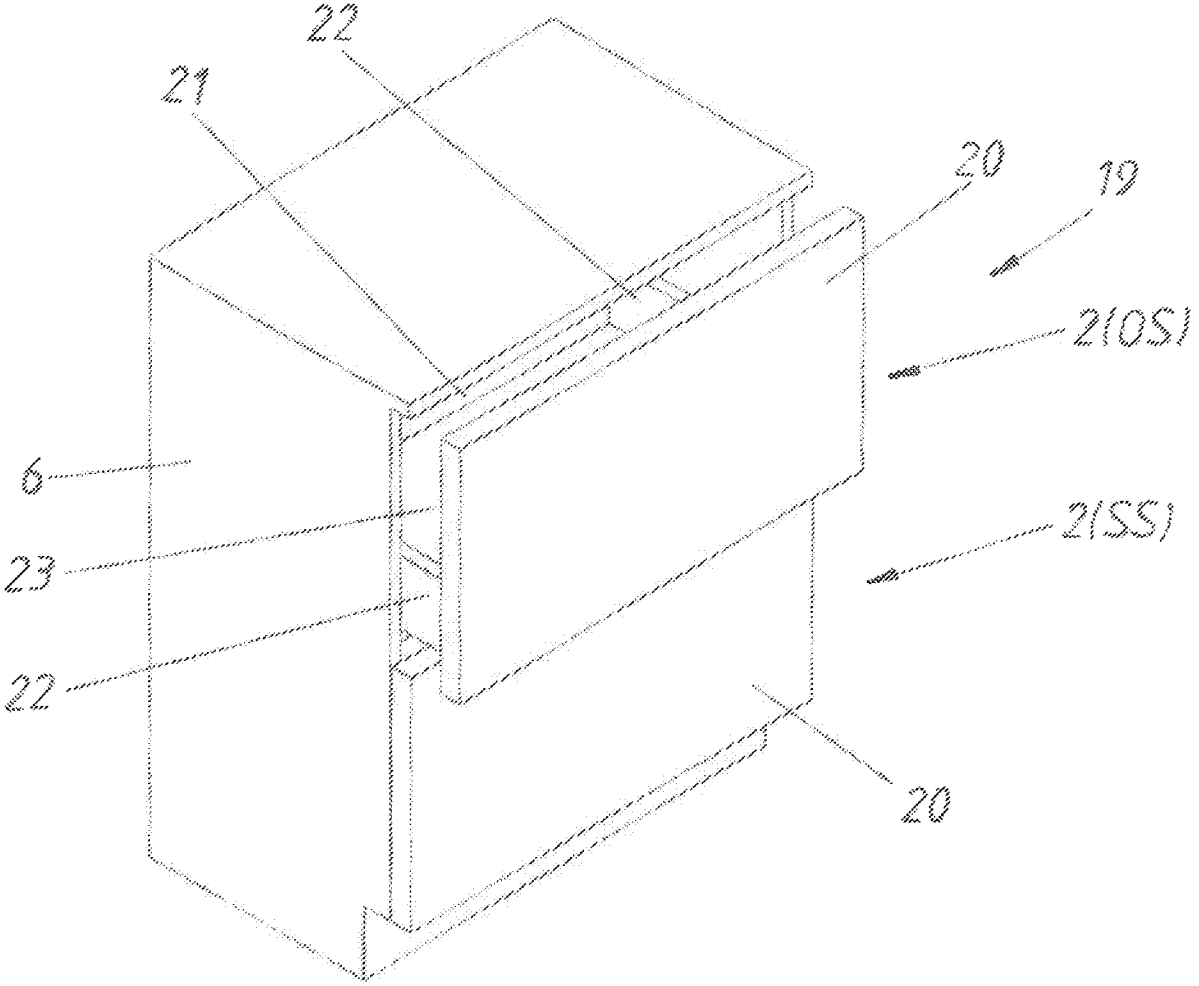
FIG. 1 shows in perspective an item of furniture with two drawers.

A perspective view of an item of furniture 19 with—in this case—two movable furniture parts 2 in the form of drawers is illustrated in FIG. 1. The two movable furniture parts 2 are linearly movable supported on a furniture carcass 6 by means of extension guides 3*a*, 3*b* (not visible here). The upper movable furniture part 2 is situated in an open position OS, whereas the lower movable furniture part 2 is situated in a closed position SS. Each drawer comprises a front panel 20, a drawer back wall 21, two drawer side walls 22 and a drawer bottom 23.

Figure 2:
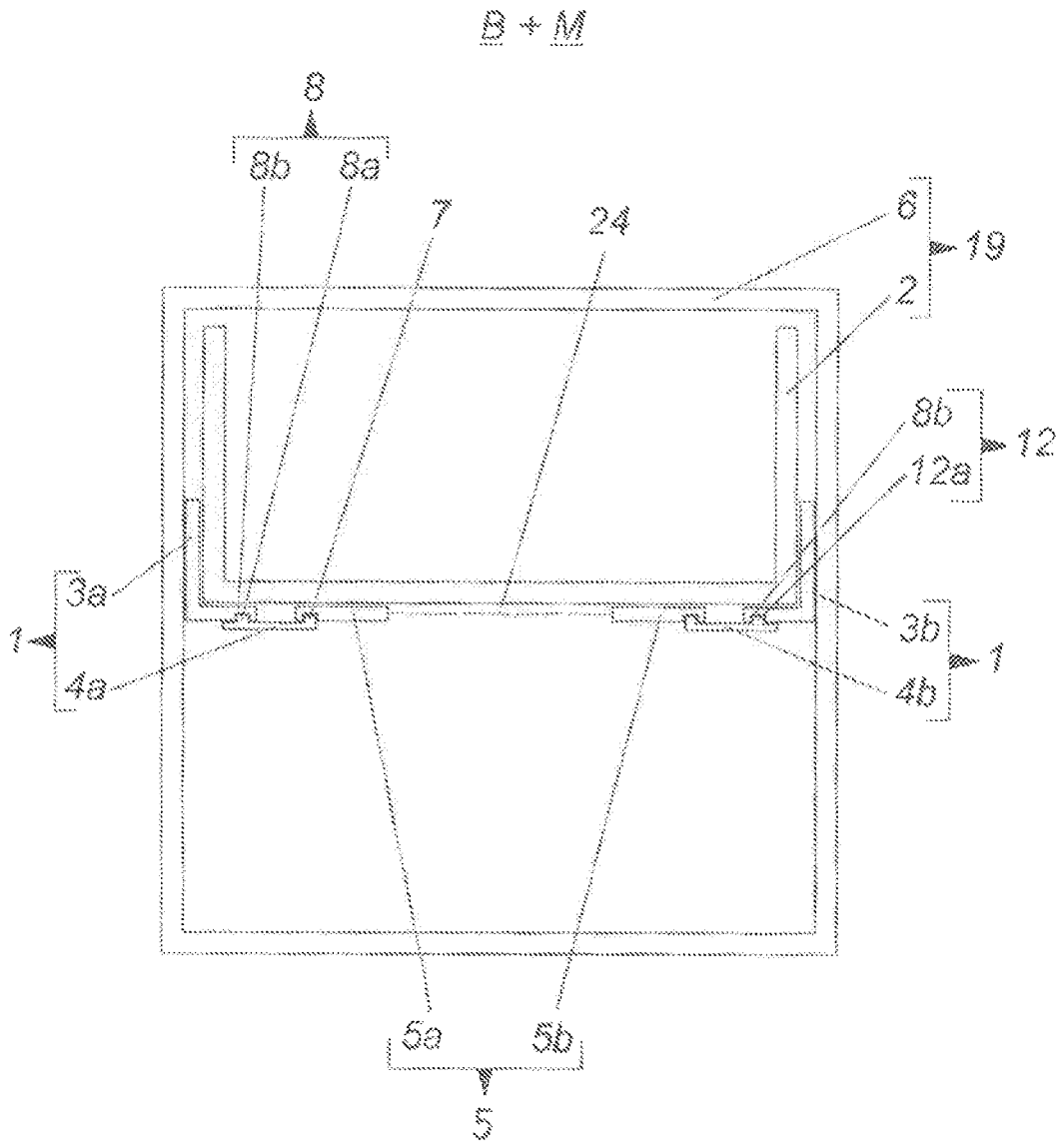
FIG. 2 shows a schematic cross section through an item furniture with a drawer, two extension guides, two entrainment members and two drive devices.

FIG. 2 shows in a schematic cross section an item of furniture 19 with a furniture carcass 6, a movable furniture part 2, a first extension guide 3*a* mounted to the furniture carcass 6 and a second extension guide 3*b* mounted to an opposing side of the furniture carcass 6. The movable furniture part 2 is detachably connected to the two extension guides 3*a* and 3*b*. A first drive device 5*a* and a second drive device 5*b* are arranged on the bottom side of the movable furniture part 2. The drive devices 5*a* and 5*b* commonly form the drive device 5 for moving the movable furniture part 2 relative to the furniture carcass 6. Where applicable, the movement of the two drive devices 5*a* and 5*b* can be synchronized by a synchronizing device 24 (illustrated in a dashed line). One entrainment member 4*a* and 4*b* is connected with each extension guide 3*a* and 3*b*. The first extension guide 3*a* together with the entrainment member 4*a* forms an arrangement 1. In the same manner, the second extension guide 3*b* together with the entrainment member 4*b* forms such an arrangement 1. Each entrainment member 4*a* and 4*b* comprises an entrainment projection 7. By means of this entrainment projection 7, the respective entrainment member 4*a* and 4*b* can be actively connected with the respective drive device 5*a* and 5*b*, preferably with a catch lever of the respective drive device 5*a* and 5*b*. The first entrainment member 4*a* is fastened to the second part 8*b* of the first fastening device 8 on the first extension guide 3*a* via the first part 8*a* of the first fastening device 8 arranged on the entrainment member 4*a*. The second entrainment member 4*b* is fastened to the second part 8*b* of the second fastening device 12 arranged on the second extension guide 3*b* via the first part 12*a* of the second fastening device 12 arranged on the second entrainment member 4*b*. In this case, thus, the second part 8*b* arranged on the second extension guide 3*b* simultaneously forms a part of the second fastening device 12. In FIG. 2, the extension guides 3*a* and 3*b* on the opposing sides are laterally reversed relative to each other, and are each situated in a fastening state B with the entrainment members 4*a* and 4*b*. The movable furniture part 2 is situated in an assembly condition M with the furniture carcass 6.

Figure 3:
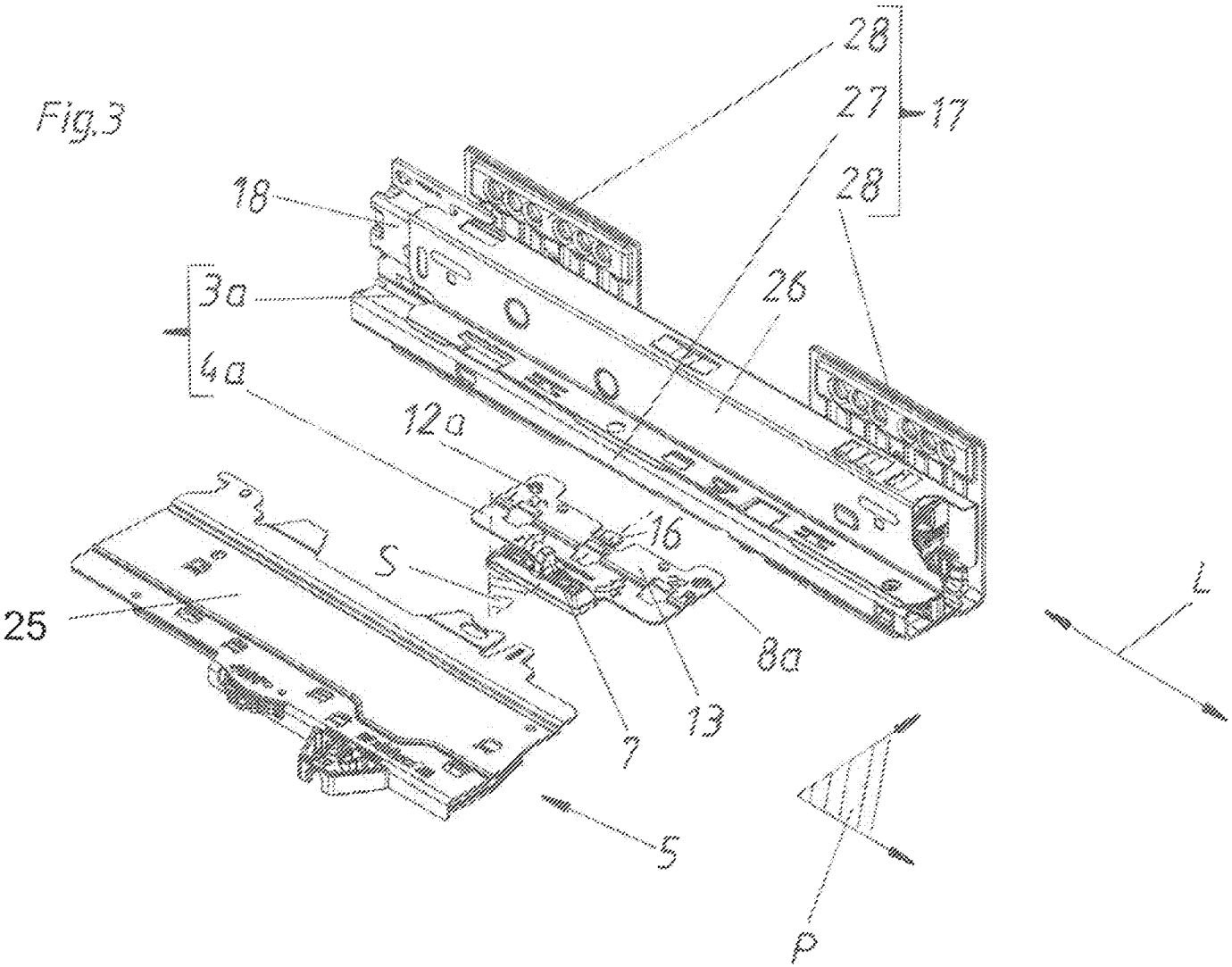
FIG. 3 shows in perspective an exploded view of an arrangement comprising an extension guide, an entrainment member and a drive device.

An arrangement 1 together with a drive device 5 is illustrated in a perspective view in FIG. 3. The drive device comprises a mounting plate 25 by way of which the drive device 5 can be fastened to the bottom side of the movable furniture part 2 or to a bearing web of a container rail 26 commonly forming the drawer side wall. The first extension guide 3*a* comprises a drawer rail 18 and a carcass rail 17. In the illustration according to FIG. 3, the drawer rail 18 is hidden by the container rail 26 for the most part. The carcass rail 17 comprises the guiding part 27 (well visible in the lower region) and the, preferably angular, mounting elements 28. These mounting elements 28 are fixedly connected, preferably welded, to the guiding part 27. Via the carcass rail 17 (preferably via its mounting elements 28) the first extension guide 3*a* is attached to the furniture carcass 6 by fastening means (not illustrated). The longitudinal axis L of the first extension guide 3*a* is visualized by a double arrow. The entrainment member 4*a* comprises the entrainment projection 7, the part 8*a* of the first fastening device 8 and the part 12*a* of the second fastening device 12.

These two parts 8*a* and 12*a* are arranged, preferably in one piece, on the base plate 13 of the entrainment member 4 in a laterally reversed manner. In addition, the clamping element 16 is arranged on the base plate 13. The base plate 13 of the entrainment member 4*a* extends substantially along a plate plane P. This plate plane P is illustrated by the area which is spanned by the two arrows. The plate plane P is oriented parallel to the longitudinal axis L of the first extension guide 3*a*. In the assembly condition M, the plate plane P is oriented horizontally. In FIG. 3 also the plane of symmetry S running centrally through the entrainment member 4*a* is visualized by the two dashed lines and the area which is spanned by these lines. In the fastening state B, the plane of symmetry S is oriented right-angled to the longitudinal axis L of the first extension guide 3*a* and right-angled to the plate plane P.

Figure 4:
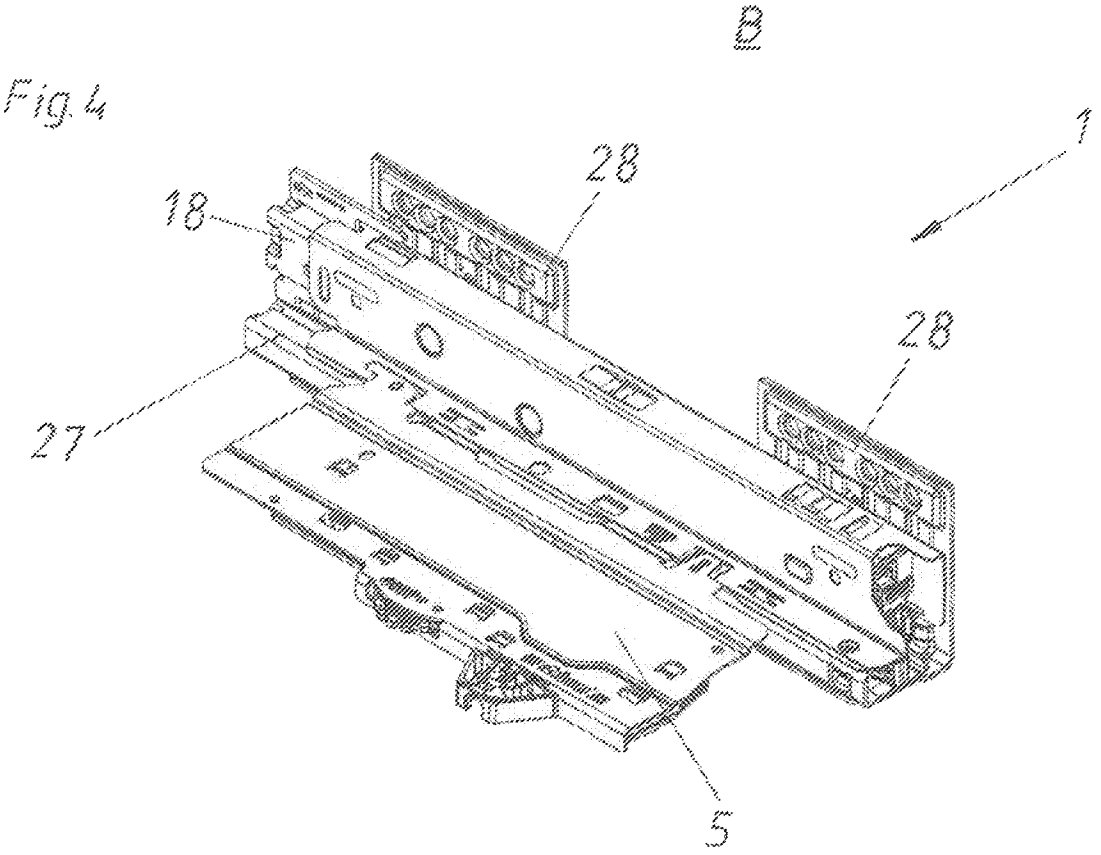
FIG. 4 shows the arrangement according to FIG. 3 in a fastening state.

The arrangement 1 together with the drive device 5 is illustrated in FIG. 4 in an assembled state. Thus, the arrangement is situated in the fastening state B.

Figure 5:
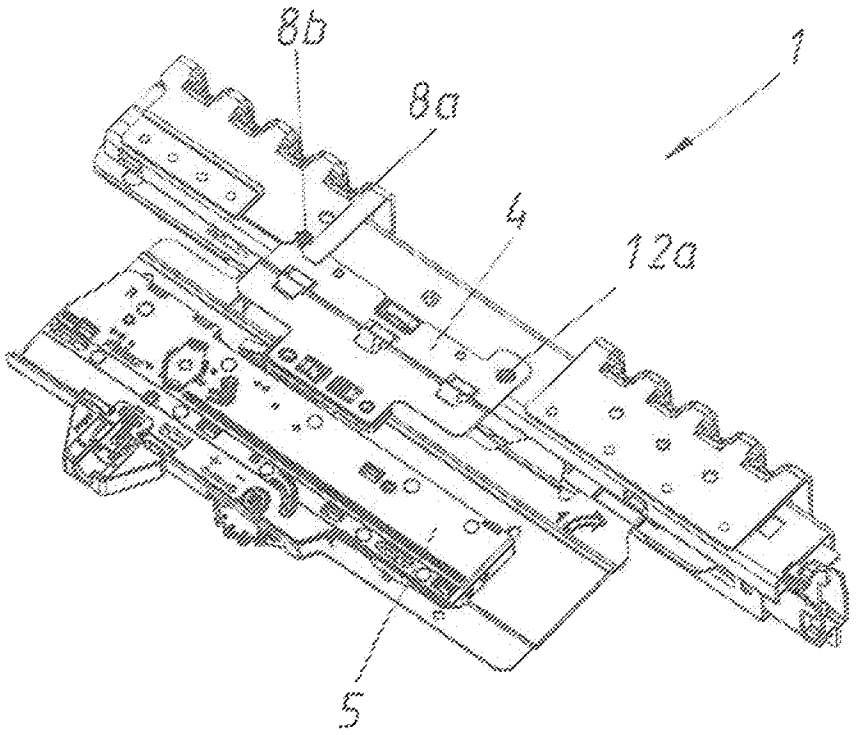
FIG. 5 shows the arrangement according to FIG. 4 from below.

FIG. 5 shows the arrangement 1 in a perspective illustration from below. It is visible to some extent that the entrainment projection 7 of the entrainment member 4*a* is actively connected to the drive device 5. The part 8*a* of the first fastening device 8 arranged on the entrainment member 4 is in a positive-locking connection with the part 8*b* of the first fastening device 8 arranged or formed on the first extension guide 3*a*. The part 12*a* of the second fastening device 12 arranged on the entrainment member 4 is distanced from (spaced apart from) the part 8*b* and, thus, in this case (or when using on this first extension guide 3*a*) functionless.

A fastening movement of the entrainment member 4*a* on the first extension guide 3*a* is illustrated in perspective in the FIGS. 6 to 9. In this exemplary embodiment, the part 8*a* of the first fastening device 8 arranged on the entrainment member 4*a* is embodied as a pin 9. Equally, the part 12*a* of the second fastening device 12 arranged on the entrainment member 4*a* is embodied as a pin 9. The part 8*b* of the first fastening device 8 arranged on the first extension guide 3*a* is embodied as a pin-receiving element 10.

Figure 6:
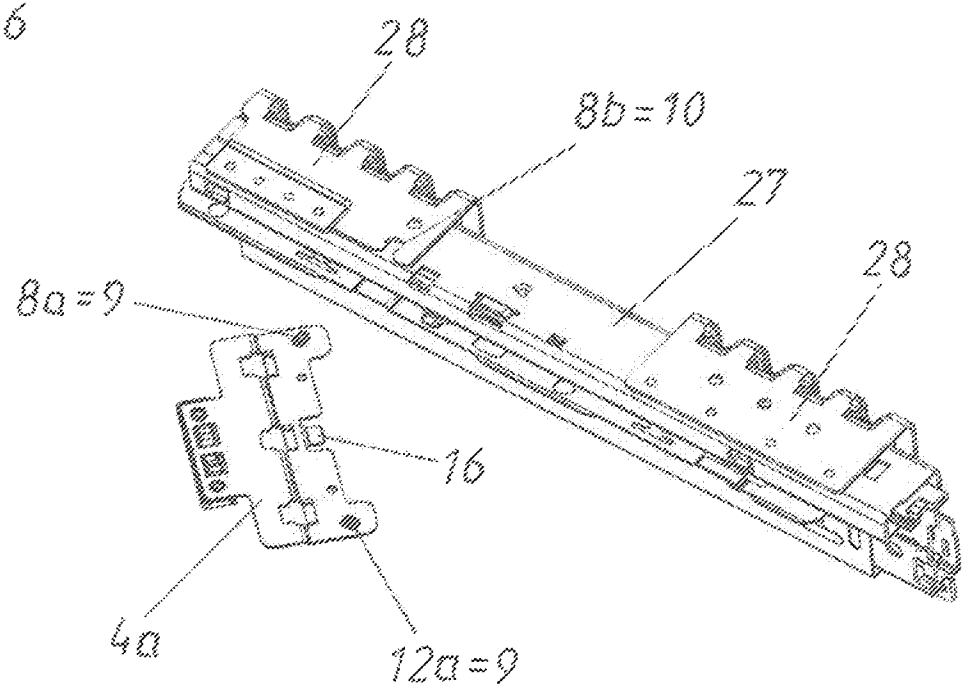
FIGS. 6 to 9 show the fastening movement of the entrainment member on an extension guide in perspective from below together with details.

In FIG. 6 the entrainment member 4*a* is still situated in a distanced position in relation to (spaced apart from) the first extension guide 3*a*. It is visible that the pin-receiving element 10 (part 8*b*) is formed in the mounting element 28 of the carcass rail 17.

Figure 7:
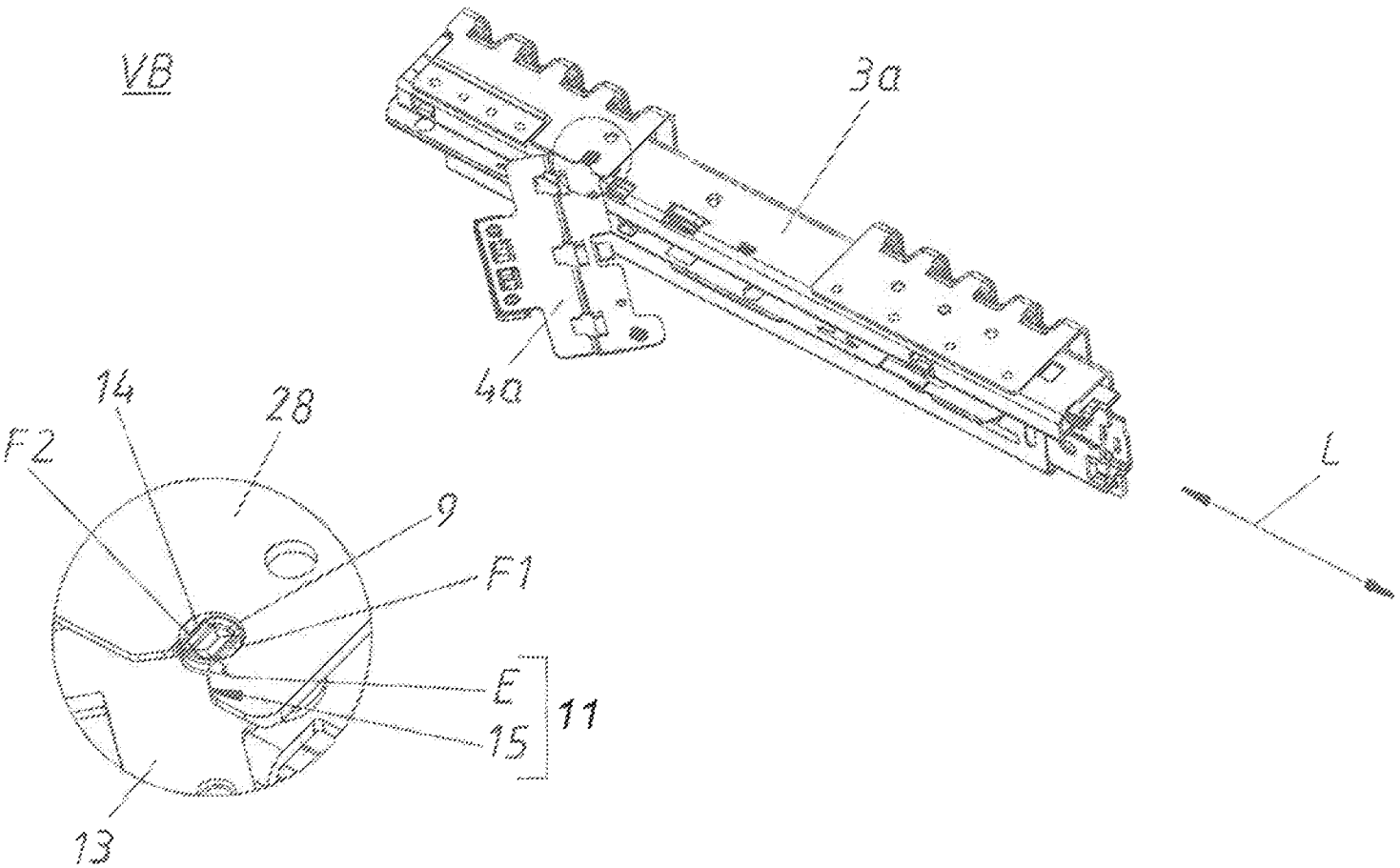

In FIG. 7, the entrainment member 4*a* has reached the pre-fastening state VB. Therefore, a small gap (see also the detail of FIG. 15) is established between the mounting element 28 illustrated on the left side and the guiding part 27 of the carcass rail 17, wherein the base plate 13 can be inserted along the plate plane P into this gap. The breadth of this gap substantially corresponds to the thickness of the base plate 13. The entrainment member 4*a*—compared to the fastening state B—is oriented obliquely to the longitudinal axis L of the first extension guide 3*a*. In the detail bottom left, it is visible that the pin-receiving element 10 comprises an insertion channel 11 with a bottleneck E. In addition, the insertion channel 11 comprises a broader threading region 15 which is tapering towards the bottleneck E. Further, the pin-receiving element 10 comprises a, preferably circular, bearing region 14. In order to reach the pre-fastening state VB, the pin 9 (with its flattened areas F1 and F2 passing the bottleneck E of the pin-receiving element 10) has been moved substantially linearly through the insertion channel 11 into the bearing region 14. Concretely, this insertion movement—when the entrainment member is positioned obliquely—is carried out substantially right-angled to the longitudinal axis L of the first extension guide 3*a*.

Figure 8:
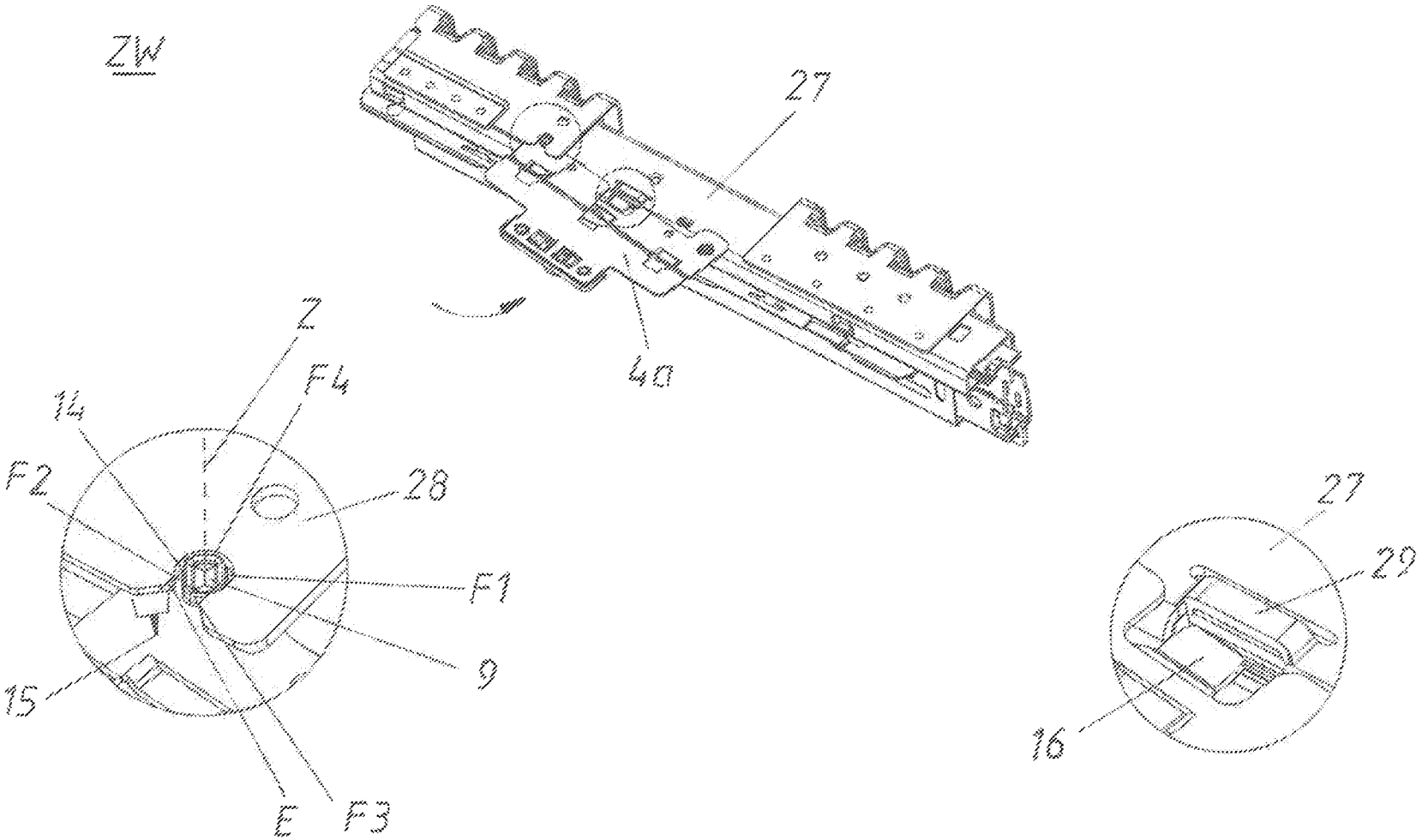

An intermediate position ZW of the fastening movement is illustrated in FIG. 8. For that purpose, the pin 9 is quasi used as a swivelling axis. According to the detail bottom left, the pin 9 comprises a vertically oriented pin axis Z. The entrainment member 4*a* is swivelled counter-clockwise around this pin axis Z as illustrated by the arrow. The swivelling movement is guided by the circular bearing region 14 and by at least one convex area F3 and F4 abutting thereon. As a consequence, the flattened areas F1 and F2 of the lateral surface F of the pin 9 are no longer oriented in an aligning manner with the bottleneck E but are positioned obliquely with respect to the bottleneck E. Thus, the two convex areas F3 and F4 of the lateral surface F at least partially abut the bearing region 14 of the pin-receiving element 10. According to the detail bottom right, the clamping element 16 has not yet reached the clamping element counter piece 29 on the carcass rail 17. Preferably, this clamping element counter piece 29 is formed as a U-shaped lug in the guiding part 27 of the carcass rail 17.

Figure 9:
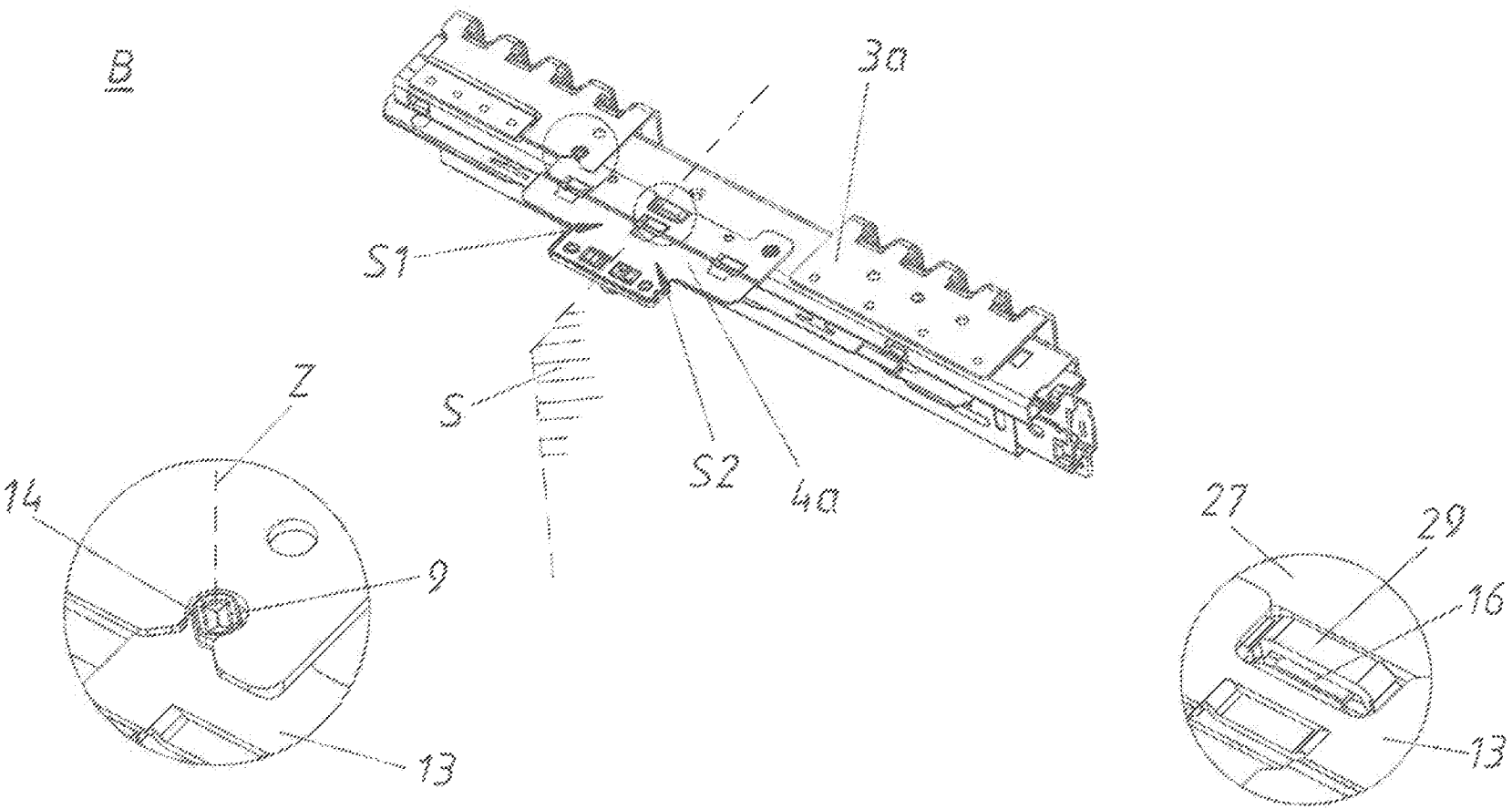

The fastening state B is reached in FIG. 9. The entrainment member 4*a* has been swivelled further around the pin axis Z compared to FIG. 8. The plane of symmetry S of the entrainment member 4*a* (which divides the entrainment member 4*a* in the two mirror-symmetrically formed symmetry areas S1 and S2) in the fastening state B is oriented right-angled to the longitudinal axis L of the first extension guide 3*a*. By the oblique arrangement of the flattened areas F1 and F2 of the pin 9 in relation to the bottleneck E of the insertion channel 11, a positive-locking connection is provided in the sense that the entrainment member 4*a* cannot be released from the extension guide 3*a* by a linear pulling movement of the entrainment member 4*a* right-angled to the longitudinal axis L of the first extension guide 3*a*. In the detail bottom right, it can be seen that the clamping element 16 is contacting the clamping element counter piece 29. Preferably, a friction-type connection is established between these two components.

Figure 10:
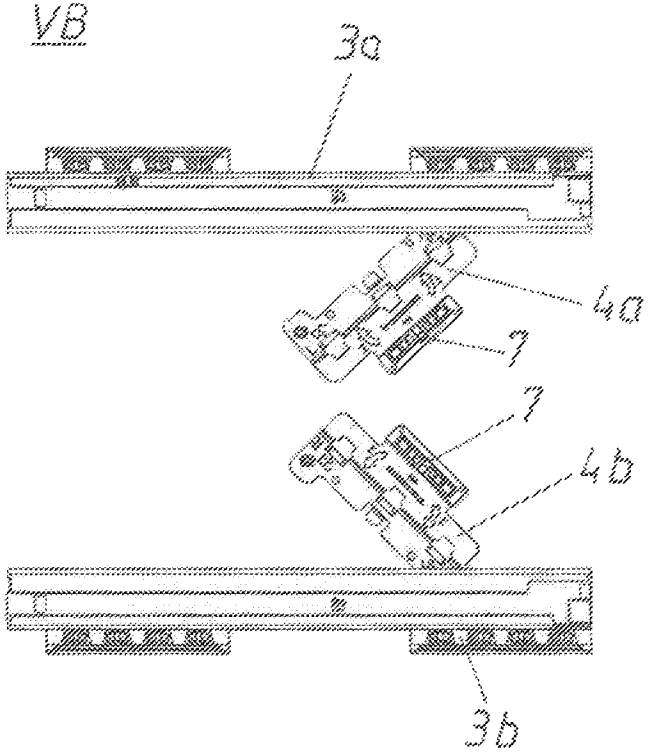
FIG. 10 shows extension guides on opposing sides from above with entrainment member in the pre-fastening state.

The two extension guides 3*a* and 3*b* as well as the two entrainment members 4*a* and 4*b* are illustrated in FIG. 10 in a top view from above. The entrainment members 4*a* and 4*b* are situated in the pre-fastening state VB.

Figure 11:
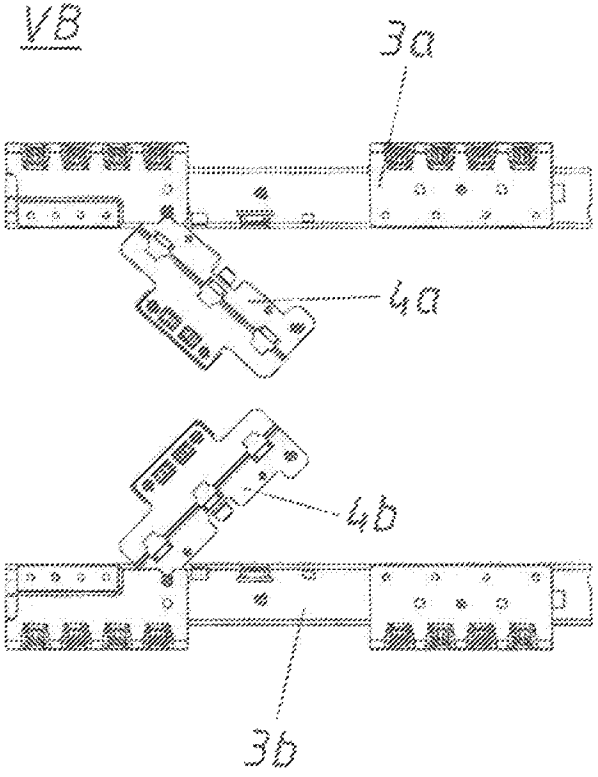
FIG. 11 shows the FIG. 10 from below.

A view from below corresponding to FIG. 10 is illustrated in FIG. 11.

Figure 12:
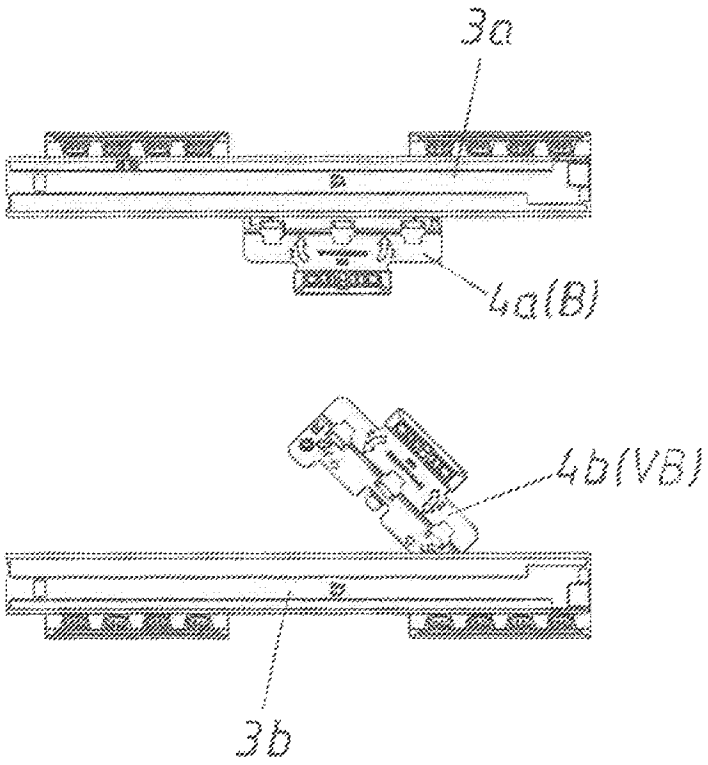
FIG. 12 shows extension guides on opposing sides from above with one entrainment member in the pre-fastening state and one entrainment member in the fastening state.

The two extension guides 3*a* and 3*b* as well as the two entrainment members 4*a* and 4*b* are illustrated in FIG. 12 in a top view from above, wherein the entrainment member 4*a* is situated in the fastening state B, while the second entrainment member 4*b* is still situated in the pre-fastening state VB.

Figure 13:
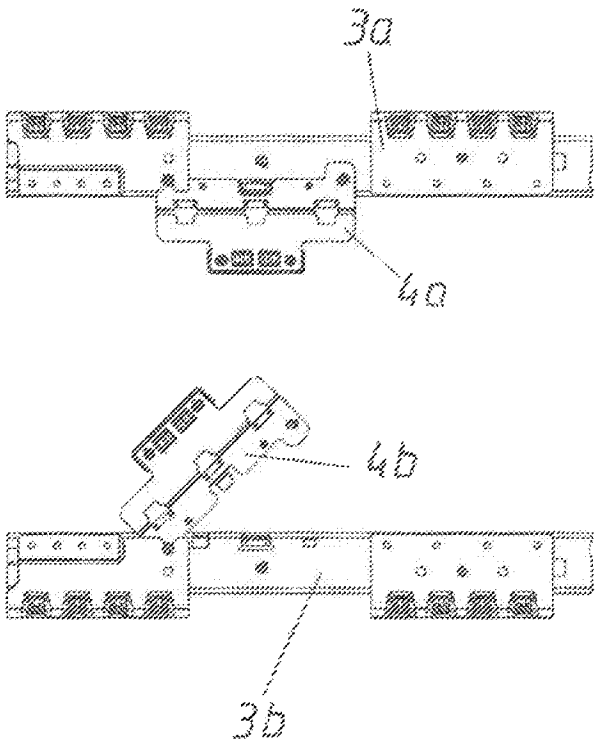
FIG. 13 shows the FIG. 12 from below.

A view from below corresponding to FIG. 12 is illustrated in FIG. 13.

FIG. 14 shows a first extension guide 3*a* together with an entrainment member 4*a* in a view from below. The vertical cross section plane, which results in the cross section A-A, is illustrated and runs through the first fastening device 8.

The cross section A-A corresponding to FIG. 14 is illustrated in FIG. 15. In the detail illustrated on the right side, the cross section A-A in the region of the fastening device is illustrated in a zoomed manner. It is visible that the pin-receiving element 10—which corresponds to the part 8*b*—is embodied in the mounting element 28 of the carcass rail 17. In particular, the bearing region 14 of this pin-receiving element 10 is illustrated. The bearing region 14 has a minimal clear width $W_{14}$ parallel to the plate plane P. In the shown detail, the pin axis Z of the pin 9 is also illustrated. The pin 9 is formed integrally with the base plate 13 of the entrainment member 4*a*. The base plate 13, in turn, directly contacts the guiding part 27 of the carcass rail 17. In addition, the shortest straight connection line V1 is illustrated in this detail, and this connection line V1 runs from the flattened area F1 of the lateral surface F of the pin 9 through the pin axis Z to the oppositely arranged flattened area F2 of the lateral surface F of the pin 9. This connection line V1 is shorter than the clear width $W_{14}$. However, this connection line V1 is almost as long as the clear width $W_{11}$ on the bottleneck E of the insertion channel. Thus, the pin 9 exactly fits through the clear width $W_{11}$.

Figure 16:
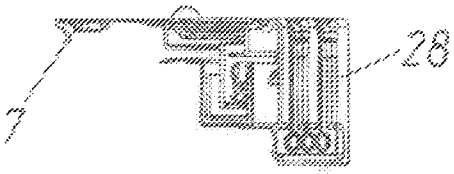
FIG. 16 shows the arrangement together with the first fastening device with a differently oriented cross section plane.
Figure 16:
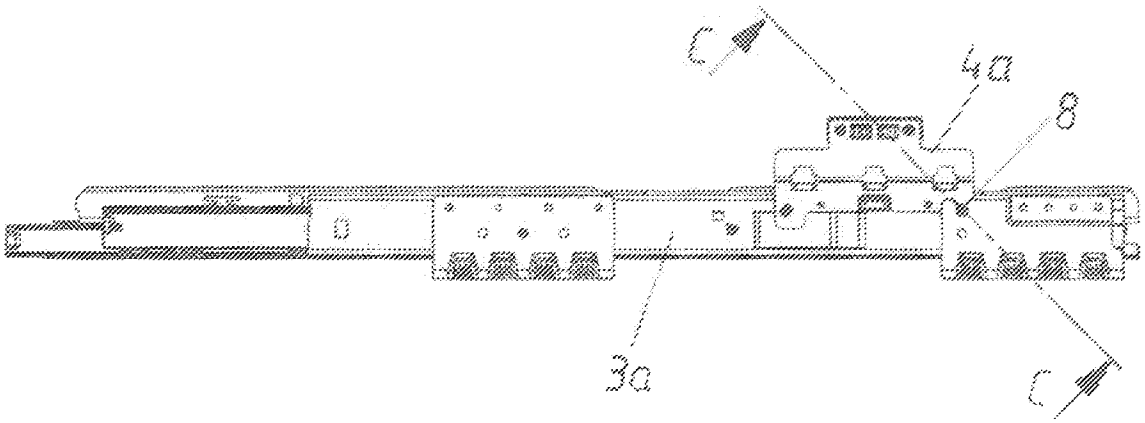

FIG. 16 shows a first extension guide 3*a* together with an entrainment member 4*a* in a view from below. The vertical cross section plane, which results in the cross section C-C, is illustrated and is—in another direction as in FIG. 14—running through the first fastening device 8.

Figure 17:
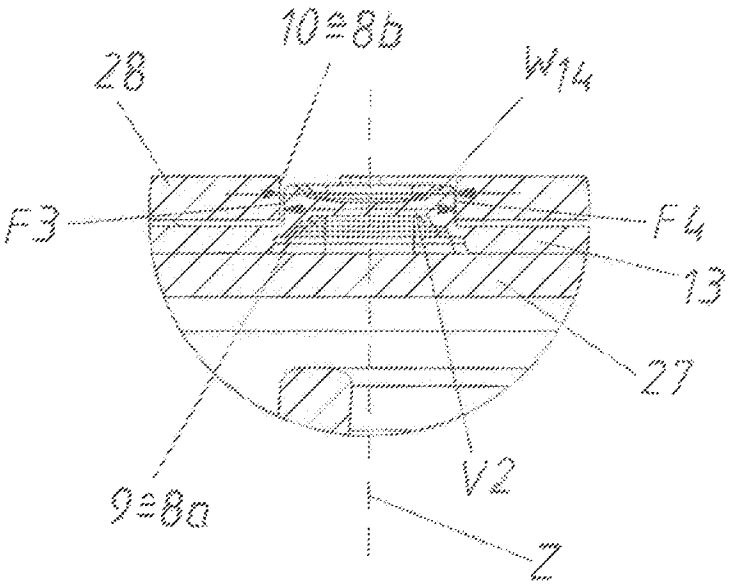
FIG. 17 shows the cross section C-C from FIG. 16 with a detail of the first fastening device.

The cross section C-C corresponding to FIG. 16 is illustrated in FIG. 17. In the detail illustrated on the right side, the cross section C-C in the region of the fastening device 8 is illustrated in a zoomed manner. The shortest straight connection line V2 is illustrated which is running from the convex area F3 of the lateral surface F of the pin 9 through the pin axis Z to the oppositely arranged convex area F4 of the lateral surface F of the pin 9. This connection line V2 is almost as long as the minimal clear width $W_{14}$ in the bearing region 14.

Figure 18:
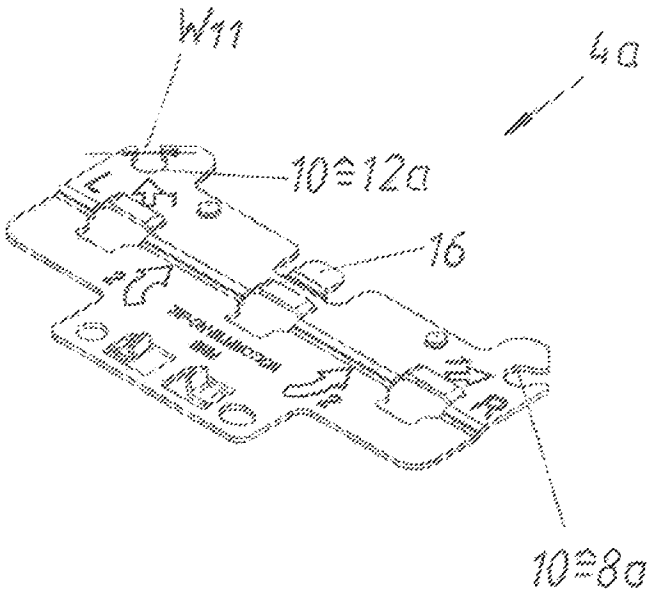
FIG. 18 shows in perspective an entrainment member of a second exemplary embodiment.

An entrainment member 4*a* of a second, alternative exemplary embodiment is illustrated in perspective in FIG. 18. Here, only the base plate 13 of the entrainment member 4*a* is illustrated. The entrainment projection 7 is not illustrated. In this variant, the part 8*a* of the first fastening device 8 arranged or formed on the entrainment member 4*a* is embodied as pin-receiving element 10. Also, the part 12*a* of the second fastening device 12 arranged or formed on the entrainment member 4*a* is embodied as pin-receiving element 10. In this illustration the minimal clear width W11 in the insertion channel 11 is visible particularly well. The two pin-receiving elements 10 are formed mirror-symmetrically to each other in the base plate 13.

Figure 19:
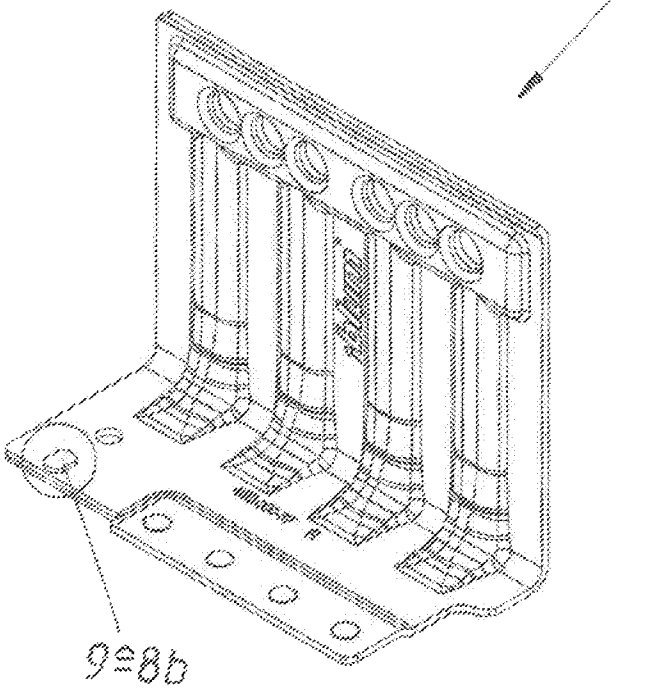
FIG. 19 shows in perspective a part of the carcass rail of a second exemplary embodiment with a detail of the pin.
Figure 19:
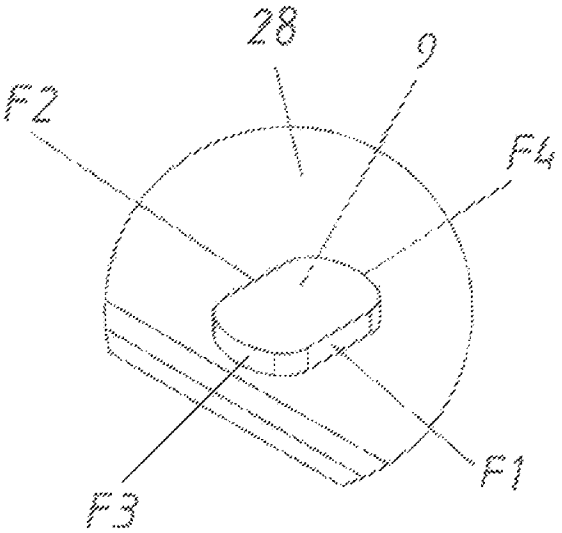

Only an angular mounting element 28 of the carcass rail 17 is illustrated in FIG. 19. The part 8*b* of the first fastening device 8 is arranged on this mounting element 28. The part 8*b* is embodied as pin 9. This pin 9 is formed integrally with the mounting element 28. In the detail shown left it is illustrated that the lateral surface F of this pin 9 comprises two flattened areas F1 and F2 and two convex areas F3 and F4. In addition, it is visible that the lateral surface F deviates from the shape of a circle in a cross section which is oriented right-angled to the pin axis Z. This cross section could also be formed—different to the illustration—e. g. polygonal or oval.

FIG. 20 shows a first extension guide 3*a* together with an entrainment member 4*a* in a view from below, wherein the second exemplary embodiment of the fastening device 8 is illustrated. The vertical cross section plane, which results in the cross section D-D, is illustrated and is running through the first fastening device 8.

The pin 9 formed on the mounting element 28 is visible in the cross section D-D of the FIG. 21 and in the detail illustrated on the right side, wherein in the fastening state B the pin 9 at least partially contacts the recess edge of the pin-receiving element 10 in the bearing region 14.

LIST OF REFERENCE SIGNS

1 arrangement
2 movable furniture part
3*a* first extension guide
3*b* second extension guide
4*a* entrainment member
4*b* second entrainment member
5 drive device
5*a* first drive device
5*b* second drive device
6 furniture carcass
7 entrainment projection
8 first fastening device
8*a* part of the first fastening device arranged on the entrainment member
8*b* part of the first fastening device arranged on the extension guide
9 pin
10 pin-receiving element
11 insertion channel
12 second fastening device
12*a* part of the second fastening device arranged on the entrainment member
13 base plate
14 bearing region
15 threading region
16 clamping element
17 carcass rail
18 drawer rail
19 item of furniture
20 front panel
21 drawer back wall
22 drawer side walls
23 drawer bottom
24 synchronizing device
25 mounting plate
26 container rail
27 guiding part
28 mounting elements
29 clamping element counter piece
L longitudinal axis of the extension guide
E bottleneck
P plate plane
M assembly condition
S plane of symmetry
S1 first symmetry area
S2 second symmetry area
B fastening state
Z pin axis
F lateral surface
F1, F2 flattened areas
F3, F4 convex areas
V1 shortest straight connection line between the flattened areas
V2 shortest straight connection line between the convex areas
$W_{11}$ minimal clear width in the insertion channel
$W_{14}$ minimal clear width in the bearing region
SS closed position
OS open position
VB pre-fastening state
ZW intermediate position

The invention claimed is:

1. An arrangement comprising:

a first extension guide for guiding a movable furniture part;

an entrainment member to be driven by a drive device for moving the movable furniture part in relation to a furniture carcass, wherein the entrainment member comprises an entrainment projection to be actively connected to the drive device; and a first fastening device including a first part arranged on the entrainment member and a second part arranged on the first extension guide, the first fastening device being configured to fasten the entrainment member to the first extension guide, wherein a first one of the first part and the second part of the first fastening device is a pin and a second one of the first part part and the second part is a pin-receiving element corresponding to the pin, wherein the pin is positioned obliquely to a longitudinal axis of the first extension guide and the pin receiving element comprises an insertion channel for receiving the pin, the insertion channel comprising a bottleneck, wherein the arrangement further includes a second fastening device including a first part arranged on the entrainment member, the first part being a pin or a pin-receiving element, the first part of the second fastening device being configured to fasten the entrainment member to a second extension guide laterally reversed in relation to the first extension guide, wherein the first part of the first fastening device arranged on the entrainment member is oriented so as to be laterally reversed in relation to the first part of the second fastening device arranged on the entrainment member, wherein the pin comprises a central pin axis and a lateral surface formed around the pin axis and which fully encloses the pin axis in a radial direction.

2. The arrangement according to claim 1, wherein the entrainment member comprises a base plate.

3. The arrangement according to claim 2, wherein the base plate extends along a plate plane.

4. The arrangement according to claim 3, wherein the plate plane is oriented parallel to the longitudinal extension of the first extension guide and horizontally in an assembly condition of the arrangement.

5. The arrangement according to claim 3, wherein the entrainment member comprises a central plane of symmetry which is right-angled to the plate plane.

6. The arrangement according to claim 5, wherein the first part of the first fastening device arranged on the entrainment member and the first part of the second fastening device arranged on the entrainment member each are arranged on a side of the central plane of symmetry laterally reversed to each other.

7. The arrangement according to claim 5, wherein the central plane of symmetry leads through the entrainment projection.

8. The arrangement according to claim 5, wherein the central plane of symmetry divides the entrainment member into a first symmetry area and a second symmetry area.

9. The arrangement according to claim 8, wherein the first symmetry area and the second symmetry area of the entrainment member are laterally reversed relative to each other.

10. The arrangement according to claim 1, wherein, in a fastening state of the arrangement, the pin rests on the pin-receiving element.

11. The arrangement according to claim 1, wherein, in an assembly condition of the arrangement, the pin projects vertically from the entrainment member or from the first extension guide.

12. The arrangement according to claim 1, wherein the central pin axis is oriented at a right angle with respect to the longitudinal axis of the first extension guide.

13. The arrangement according to claim 1, wherein the lateral surface deviates from a circular shape in a cross section which is right-angled to the pin axis.

14. The arrangement according to claim 13, wherein, in the cross section right-angled to the pin axis, the lateral surface comprises two flattened areas on radially opposing sides and two convex areas on radially opposing sides.

15. The arrangement according to claim 14, wherein the shortest straight connection line leading through the pin axis between the flattened areas is shorter than the shortest straight connection line leading through the pin axis between the convex areas.

16. The arrangement according to claim 1, wherein the pin-receiving element is formed in the entrainment member or in the first extension guide, and a recess edge of the pin-receiving element is on the entrainment member or on the first extension guide.

17. The arrangement according to claim 1, wherein the pin-receiving element comprises a bearing region for the pin, the bearing region being separate from the insertion channel.

18. The arrangement according to claim 1, wherein the insertion channel comprises a broader nozzle-shaped threading region adjacent to the bottleneck.

19. The arrangement according to claim 1, wherein the pin is configured to pass the bottleneck of the pin-receiving element during a mounting movement only when the entrainment member is positioned obliquely relative to the longitudinal extension of the first extension guide.

20. The arrangement according to claim 1, wherein the first part of the first fastening device and the first part of the second fastening device are each a pin, and the pin-receiving element is arranged on the first extension guide.

21. The arrangement according to claim 1, wherein only one pin or one pin-receiving element is arranged on the first extension guide.

22. The arrangement according to claim 1, wherein in an assembly condition of the arrangement, the first part of the second fastening device is distanced from the second part of the first fastening device.

23. The arrangement according to claim 1, wherein the entrainment member comprises a tongue-shaped clamping element separate from the first and second parts of the first and second fastening devices, the clamping element being connected to the extension guide in an assembly condition.

24. The arrangement according to claim 23, wherein a plane of symmetry runs centrally through the clamping element.

25. The arrangement according to claim 1, wherein the first extension guide comprises a carcass rail and a drawer rail movable relative to the carcass rail.

26. The arrangement according to claim 25, wherein the second part of the first fastening device arranged on the first extension guide is on the carcass rail.

27. The arrangement according to claim 26, wherein the second part of the first fastening device arranged on the carcass rail is formed integrally with the carcass rail so as to be formed into the carcass rail.

28. The arrangement according to claim 1, further comprising the second extension guide laterally reversed relative to the first extension guide.

29. The arrangement according to claim 28, wherein the entrainment member is a first entrainment member, the arrangement further comprising a second entrainment member to be attached to the second extension guide, the second entrainment member being formed identically to the first entrainment member associated with the first extension guide.

30. The arrangement according to claim 28, wherein the drive device is a first drive device associated with the first extension guide, further comprising a second drive device associated with the second extension guide.

31. The arrangement according to claim 1, further comprising a drive device for moving the movable furniture part relative to the furniture carcass, wherein the drive device is to be actively connected to the entrainment member.

32. An item of furniture comprising a furniture carcass, a movable furniture part, and the arrangement according to claim 1.

33. The item of furniture according to claim 32, wherein the arrangement comprises two drive devices, wherein a first one of the two drive devices is associated with the first extension guide and with the entrainment member, and a second one of the two drive devices is associated with the second extension guide and with the second entrainment member.

34. The item of furniture according to claim 33, wherein, in a closed position of the movable furniture part, the first one of the drive devices rests on the entrainment member and the second one of the drive device rests on the second entrainment member.

35. A method for fastening the entrainment member of the arrangement according to claim 1 to the first extension guide, comprising bringing the entrainment member from a pre-fastening state, in which the entrainment member is positioned obliquely relative to the longitudinal axis of the first extension guide, into a fastening state with the first extension guide, the bringing of the entrainment member into a fastening state being performed by moving the pin through the bottleneck of the insertion channel and subsequently swivelling around the pin of the first fastening device.

36. The method according to claim 35, wherein the entrainment member is a first entrainment member, the method further comprising bringing a second entrainment member formed identically to the first entrainment member from a pre-fastening state, in which the second entrainment member is positioned obliquely relative to the longitudinal axis of the second extension guide, into a fastening state with the second extension guide by the first part of the second fastening device arranged on the second entrainment member and by the second part of the first fastening device arranged on the second extension guide, the bringing of the second entrainment member into the fastening state being carried out by moving the pin through the bottleneck of the insertion channel and subsequently swivelling around the pin of the first fastening device.

37. An arrangement comprising:

a first extension guide for guiding a movable furniture part;

an entrainment member to be driven by a drive device for moving the movable furniture part in relation to a furniture carcass, wherein the entrainment member comprises an entrainment projection to be actively connected to the drive device; and a first fastening device including a first part arranged on the entrainment member and a second part arranged on the first extension guide, the first fastening device being configured to fasten the entrainment member to the first extension guide, wherein a first one of the first part and the second part of the first fastening device is a pin and a second one of the first part part and the second part is a pin-receiving element corresponding to the pin, wherein the pin is positioned obliquely to a longitudinal axis of the first extension guide and the pin receiving element comprises an insertion channel for receiving the pin, the insertion channel comprising a bottleneck, wherein the arrangement further includes a second fastening device including a first part arranged on the entrainment member, the first part being a pin or a pin-receiving element, the first part of the second fastening device being configured to fasten the entrainment member to a second extension guide laterally reversed in relation to the first extension guide, and wherein the first part of the first fastening device arranged on the entrainment member is oriented so as to be laterally reversed in relation to the first part of the second fastening device arranged on the entrainment member, wherein the pin-receiving element comprises a bearing region for the pin, the bearing region being separate from the insertion channel, wherein a minimal clear width in an area of the bottleneck of the insertion channel is smaller than a minimal clear width in the bearing region.

* * * * *